United States Patent [19]

Mendenhall

[11] Patent Number: 4,606,170

[45] Date of Patent: Aug. 19, 1986

[54] SHELF EDGING STRIP

[76] Inventor: Walter M. Mendenhall, 512 Lillian Dr., Madeira Beach, Fla. 33738

[21] Appl. No.: 650,176

[22] Filed: Sep. 13, 1984

[51] Int. Cl.[4] ..... E04C 2/38

[52] U.S. Cl. ..... 52/823; 108/27; 52/783; 52/821; 211/135

[58] Field of Search ..... 52/823, 824, 783, 784, 52/803, 821; 108/27; 211/135

[56] References Cited

U.S. PATENT DOCUMENTS

| | | | |
|---|---|---|---|
| 2,115,130 | 4/1938 | Thurn et al. | 52/823 |
| 2,663,390 | 12/1953 | Dordel | 52/823 |
| 2,743,980 | 5/1956 | Hobbs | 52/783 |
| 2,853,750 | 9/1958 | Davies et al. | 52/823 |
| 3,001,246 | 9/1961 | Mather | 52/823 |
| 3,418,780 | 12/1968 | Dalton et al. | 52/823 |
| 4,503,780 | 3/1985 | Apissomian | 108/27 |

FOREIGN PATENT DOCUMENTS

| | | | |
|---|---|---|---|
| 515258 | 11/1939 | United Kingdom | 211/135 |

*Primary Examiner*—William F. Pate, III
*Assistant Examiner*—Caroline Dennison
*Attorney, Agent, or Firm*—Renner, Otto, Boisselle & Lyon

[57] ABSTRACT

A decorative shelf edging strip has a generally L-shaped cross section. The strip cooperates with a metal shelf having two successive bends forming a front face and underturned lip. The front face of one of the legs of the L is treated with a decorative coating which may simulate wood grain for decorating the front face of the shelf. The second leg of the L-shaped strip terminates in a hook which engages the edge of the underturned lip of the shelf. The first and second legs of the strip form an angle slightly less than 90° and the second leg further includes a small dogleg bend. A rib extends along the length of the strip from the upper portion of the first leg. Upon installation, the hook is first engaged with the rear edge of the underturned lip of the metal shelf. Then, as the strip is pivoted into place, the rib rides along the front face of the metal shelf and opens the angles of the strip slightly as the rib moves to the crest of the bend between the top surface and front face of the metal shelf. The resiliency of the material causes the angles to close slightly after the rib passes beyond the crest, thereby providing a snap action to hold the strip in place.

4 Claims, 5 Drawing Figures

SHELF EDGING STRIP

FIELD OF THE INVENTION

The present invention relates to a shelf edging strip used together with shelves especially for retail displays.

BACKGROUND OF THE INVENTION

Retailers often display merchandise on metal shelves supported by metal brackets which extend outward from a wall or support structure. A type of metal shelf which is commonly used for such a purpose comprises a sheet metal member with an L-shaped bent portion at its front edge. The L-shaped bent portion forms a downwardly extending front face which is generally perpendicular to the shelf's major plane. The distal end of the L-shaped bent portion forms an underturned lip parallel to the shelf plane. The bends help make the shelf rigid and prevent rough edges at the front of the shelf.

SUMMARY OF THE INVENTION

The present invention provides an edging strip for a shelf of the character described. The edging strip of the present invention has an outwardly facing surface to which a decorative coating, e.g., simulated wood grain, may be applied. This surface may be longer than the vertical thickness of the shelf, creating the impression of a shelf thicker than it actually is and provides an upwardly extending lip which may help retain merchandise on the shelf.

The shelf edging strip is shaped to snap into place on the metal shelf. The strip is formed of a resilient plastic and has a generally L-shaped cross section. A first leg of the L covers the front face of the metal shelf. A second leg of the L extends away from the first leg, and terminates with a hook which hooks around the distal end of the underturned lip of the metal shelf and assists in securing the shelf edging strip in place. A rib projects away from the first leg of the L, in spaced relation to the second leg. The rib extends perpendicular to the plane of the first leg, and parallel to the top surface of the shelf. The second leg of the L preferably extends away from the first leg at an angle of slightly less than 90° to the first leg. Further, the second leg has a shallow bend or dogleg partway along its length, near the hook at its distal end. The spacing between the rib and the first leg, and the geometry of the second leg is designed so that the strip can be snapped onto a shelf, with the first leg of the strip held against the front edge of the shelf, and the outwardly facing surface of the strip providing a decorative coating for the shelf.

The invention, then, comprises the features hereinafter fully described and particularly pointed out in the claims, the following description and annexed drawings setting forth in detail an illustrative embodiment of the invention, this being indicative, however, of but one of the various ways in which the principles of the present invention may be carried out.

DESCRIPTION OF PREFERRED EMBODIMENT

Figure 1:
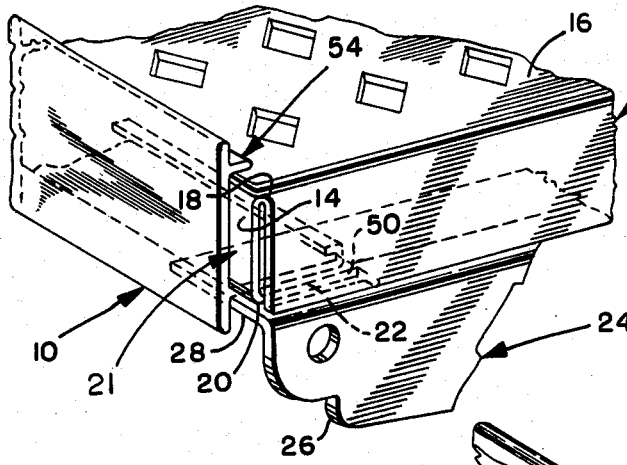
FIG. 1 is a fragmentary, schematic illustration of a shelf edging strip secured to a metal shelf, according to the present invention.

The present invention provides a shelf edging strip 10 together with a metal shelf 12 of a type commonly used in retail establishments. The strip 10 protects and decorates the front face or edge 14 of the shelf. The strip 10 is intended for use with the particular shelf 12, but as will become clear from what follows, the principles of the present invention may be readily applied to shelves having different proportions.

The shelf 12 is a sheet metal article having a top planar portion 16 upon which articles of merchandise rest. The top portion 16 may be solid or may have a plurality of diamond shaped cut-outs as shown. The front of sheet metal shelf is bent, at 18 and 20, into an L-shaped portion comprising a downwardly extending front portion 21 carrying the front face 14, and an underturned lip 22. The front face 14 is generally perpendicular to the top surface 16 while the underturned lip 22 is generally parallel to the top surface. Although the front face 14 is shown as being planar between the two bends 18 and 20, as a practical matter resulting from the bending process used to make the shelf, the front face 14 may have a slight convex curvature. This is of no consequence to the present invention so long as the shelves for which the shelf edging strips 10 are intended are generally uniform and the curvature of the front face 14 is known so that the shelf edging strips 10 may be proportioned accordingly. The front face 14 and underturned lip 22 add rigidity to the front portion of the shelf 12 and help avoid the presence of rough edges at the front of the shelf 12.

Generally, a shelf 12 would be supported by a conventional bracket 24 at each of its longitudinal ends (only one bracket 24 is shown). The bracket 24 may be mounted to a fixture which permits such mounting at different levels according to the needs of the retailer. The bracket 24 includes a generally vertical portion 26 and a horizontal portion 28 which extends under the shelf 12 and on which the shelf rests.

The shelf edging strip 10 attaches to the front of the shelf 12. The strip 10 (FIGS. 2 and 3) is preferably a unitary structure formed of polyacrylic plastic. The strip 10 is generally L-shaped in cross section and includes a first leg 30 which is planar and, when attached to a shelf, extends more or less parallel to the front face 14 of the shelf 12 and perpendicular to the top surface 16. The first leg 30 extends along the front face 14, and also includes upper and lower extensions 32 and 34, respectively, which project or extend above and below, respectively, the top shelf surface 16 and the bottom of the underturned lip 22. In this way the overall height of the first leg 30 of the strip 10 may exceed the thickness of the shelf 12, i.e., the length of the front face 14 of the shelf.

Figure 2:
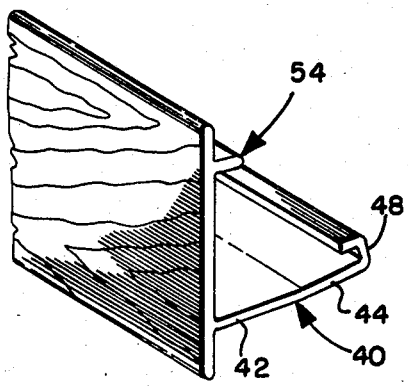
FIG. 2 is a perspective illustration of a fragmentary portion of a shelf edging strip according to the present invention.
Figure 3:
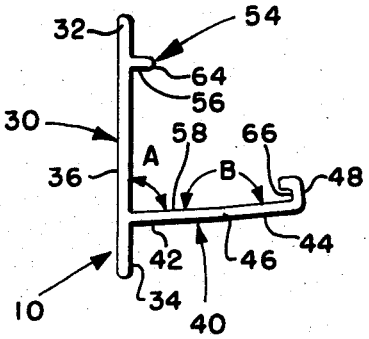
FIG. 3 is an end view of the shelf edging strip.

The outside face 36 of the first leg 30 preferably carries a decorative coating as indicated in FIG. 2. Such a decorative coating may be applied by painting, printing, or other known ways of decorating polyacrylic plastics. Although simulated wood grain has been commercially accepted, other patterns and decorations are certainly possible.

The second leg 40 (FIG. 3) of the L-shaped strip 10 is designed to extend generally along the bottom of the underturned lip 22 (FIG. 1). The second leg 40 includes a first portion 42 which extends away from the first leg 30 and a second portion 44 extending at an obtuse angle to the first portion. Together the first and second portions 42 and 44 of the second leg 40 define a shallow dogleg bend 46. The second leg 40 terminates at its distal end with a hook 48 which is proportioned to grip the distal end 50 of the underturned lip 22 of the shelf assembly 12.

The strip 10 (FIG. 3) is preferably extruded out of polyacrylic plastic. When formed and before installation on a shelf the first leg 30 and the portion 42 of the second leg 40 contiguous with the first leg 30 form an angle A of slightly less than 90°. In one preferred embodiment, the angle A is about 87°, and the angle B of the dogleg 46 is about 177°.

The strip 10 (FIG. 3) also includes a rib 54 which extends generally perpendicular to the first leg 30 along the upper portion thereof. The rib 54 is substantially shorter than the second leg 40 and is intended to engage the top surface 16 of the shelf 12. Where the front portion 23 of shelf 12 is about 0.59" high and the underturned lip 22 has a width of similar dimension, the rib 54 may be approximately ⅛" wide. The rib 54 is positioned with respect to the second leg 40 so that the undersurface 56 of the rib 54 is spaced from the upper surface 58 of the first portion 42 of the second leg 40 by no more than the total vertical thickness of the shelf 12, but may be less than such vertical dimension by as much as 0.005".

The rib 54, the first leg 30 and second leg 40 cooperate to grip the shelf 12 so that the strip 10 holds itself in place. To install the strip 10 the hook 48 is engaged about the distal end 50 of the underturned lip 22 (FIG. 4) while the first leg 30 is canted in a counterclockwise direction (as viewed in the Figures) from its installed orientation. Then, the strip 10 is pivoted clockwise until the rib 54 touches the front edge 14 of the shelf 12. Further clockwise movement of the strip 10 causes the angle A to flex, opening to 90° or more. Simultaneously, the dogleg bend B straightens and may approximate 180°. The first leg 30 may also bend, arching to be slightly concave opening away from the front edge 14 of the shelf. Once the rib 54 moves beyond the crest of the bend 18 of the shelf 12, the edging strip 10 snaps into place with the resilience of the plastic material of which it is formed causing angle A to return toward 87° and angle B toward 177°. The remaining stress within the strip 10 holds it in place.

As illustrated in FIG. 1, the second leg 40 of the strip 10 may be clamped between the horizontal portion 28 of the shelf supporting bracket 24 and the underturned lip 22. While this clamping occurs only at opposite ends of the shelf 12, it serves to assure that the edging strip 10 cannot be inadvertently removed.

The operation and snap action of the strip 10 can be explained by noting the relationship between arc 60 (FIG. 4) and the contour of the shelf assembly 12. The arc 60 is centered about point 62 located at the middle of the inside of the hook 48. The arc 60 has a radius equal to the distance between the center 62 and the point of contact 64 of the rib 54 with the shelf assembly 12. Of course the location of points 62 and 64 are approximate only since the actual point of contact 64 of the rib 54 with the shelf moves during the installation process as does the point of contact of the hook 48 with the underturned lip 22. Nevertheless, the movement of these points is sufficiently small that they suffice to illuminate the snap action. Additionally, although this description proceeds in two dimensions, it will be readily understood that the strip 10 extends axially along the entire length of the front face 14 of the shelf 12 and that the "points" are actually "lines" of contact, the "lines" in FIGS. 4 and 5 extending perpendicular to the plane of paper.

Figure 4:
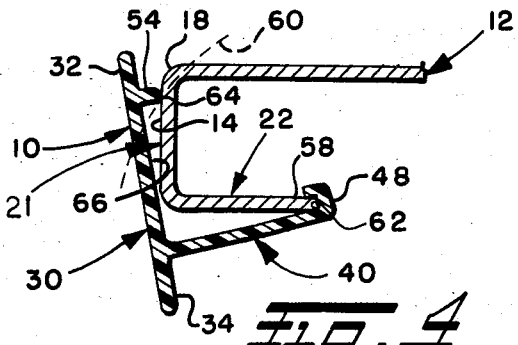
FIG. 4 is a sectional view of the shelf edging strip of the present invention partially installed on a metal shelf.

As the strip 10 is installed it must pivot approximately about the center 62. The point 64 on the rib 54 follows along arc 60 until it makes contact with the front edge 14 of the shelf 12. This position is illustrated in FIG. 4. The point 64 must then follow the contour of the shelf 12. To do so, it must move radially outward from the point 62 away from the bend 18. This causes angles A and B to open and places tension or stress in the strip 10. The increasing angles and stress continues until the point 64 reaches the crest of bend 18 of the shelf 12. Then, the contact point 64 moves radially inward again to decrease the tension in the strip 10 slightly as the angles A and B relax toward their initial states (see FIG. 5). The remaining distortion of angles A and B and the resulting internal stress cause the inside surface 66 of the first leg 60 to abut the front face 14 of the shelf while the rib 54 presses against the shelf top 16 and the hook 48 engages the end 58 of the underturned lip 22.

Figure 5:
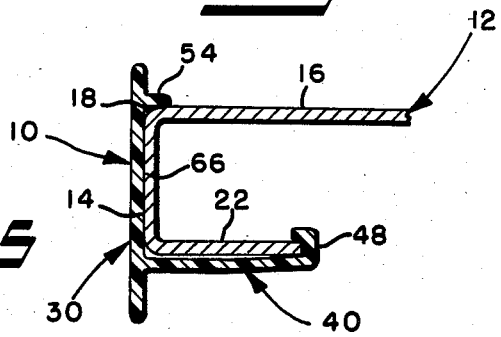
FIG. 5 is a sectional view showing the shelf edging strip of the present invention fully installed.

When installed, the hook 48 prevents the strip 10 from moving away from the front face 14, i.e., to the left as viewed in FIG. 5. The rib 54 is pressed down against the top surface 16 of the shelf 12 by the leg 40 because of the distortion of angles A and B. Thus the rib 54 and second leg 40 prevent up and down movement of the strip 10.

It can be seen therefore that some range in proportions is possible while still embodying the present invention. The shelf thickness and length of the underturned lip are shown as being approximately equal. This need not be so. Moreover, the radius of the bend 18 between the shelf surface and the front edge must be smaller than the radius of the arc 60 to assure that the corner of the bend 16 projects beyond the arc 60.

The width of the rib 54 could be increased or decreased. As a lower limit to its width, the rib 54 must be wide enough that it will move at least partway beyond the crest of the bend 16 when fully installed as shown in FIG. 5. Put another way, the distance between point 62 at the middle of the back edge of the underturned lip 22 and the crest of the bend 18 between the top surface 16 and the front face 14 of the shelf 12 must be greater than the distance between the middle 66 of the back of the hook 48 (FIG. 3) and the point of contact 64 of the rib 54 with the shelf 12. This guarantees that the angles A and B will be distorted and the strip 10 placed under stress as the rib 54 moves over the crest of the bend 18. As an upper limit to the width of the rib 54, the rib must not be so wide that it would cause permanent deformation of the strip 10 during installation, that is, all deformation of the strip 10 must remain in the elastic range.

Although the preferred and commercial embodiment of the present invention has angles A and B with values of about 87° and 177°, respectively, they may vary so long as the point of contact 64 of the rib 54 causes distortion and therefore tension in the strip 10 as it moves over the crest of the bend 16 while the strip is being snapped onto the shelf 12. Also, the angles A and B are selected to provide some residual stress so that the leg 40 and rib 54 grip the shelf when the strip 10 is installed.

I claim:

1. In combination, a sheet metal shelf and a shelf edging strip; said shelf having a front wall, a substantially planar top wall extending away from said front wall, and a bottom wall extending away from said front wall; said top wall forming an upper corner with said front wall and said bottom wall forming a lower corner with said front wall; said bottom wall having a distal end spaced by a predetermined distance from said front wall; said shelf edging strip comprising a molded article formed from a resiliently deflectable plastic material; said molded article including a substantially planar front portion, a substantially planar top rib extending away from said substantially planar front portion, and a bottom leg extending away from said substantially planar front portion; said front portion and said bottom leg of said shelf edging strip being juxtaposed, respectively, to said front and bottom walls of said shelf; said planar top rib of said shelf edging strip having a surface engaged with a mating surface of said planar top wall; said bottom leg of said shelf edging strip extending away from said front portion by a distance that is greater than the distance said top rib extends away from said front portion, and the distal end of said bottom leg having a hook that is hooked about said distal end of said bottom wall of the shelf; the top rib and the bottom leg of the shelf edging strip forming respective corners with the front portion of the shelf; the distance between the hook at the distal end of the bottom leg and the distal end of the top rib being less than the distance between the distal end of the bottom lip of the shelf and the corner formed between the front wall of the shelf and the top surface wall of the shelf; so that when the hook of the shelf edging strip is hooked about the distal end of the bottom lip of the shelf the planar top rib is resiliently urged into engagement with the planar top wall of the shelf; the front portion of the shelf edging strip being held in juxtaposed relation to the front wall of the shelf when the top rib of the shelf edging strip is being resiliently urged against the top surface of the shelf.

2. A sheet metal shelf and a shelf edging strip as set forth in claim 1, wherein said front portion of said shelf edging strip is planar and extends at a right angle to said top rib of said shelf edging strip.

3. A sheet metal shelf and a shelf edging strip as set forth in claim 2, wherein said front portion of said shelf edging strip has an integral lip extending above the plane of said top rib.

4. A sheet metal shelf and a shelf edging strip as set forth in claim 3, wherein said bottom leg of said shelf edging strip includes a first portion extending away from said front portion and a second portion extending away from said first portion to the distal end of said bottom leg; said first portion extending away from said front portion at a 90° angle and said second portion being in a state of tension in which it is urged into substantially parallel relation to said first portion when said shelf edging strip is secured to said shelf; said second portion being resiliently biased toward a condition in which said second portion extends away from said first portion at approximately 87° thereto.

* * * * *